United States Patent [19]

Ruebesam

[11] 4,273,037

[45] Jun. 16, 1981

[54] COMPACTOR

[76] Inventor: George B. Ruebesam, R.R. #1, Box 12A, Readsboro, Vt. 05350

[21] Appl. No.: 79,170

[22] Filed: Sep. 26, 1979

[51] Int. Cl.[3] ..... B30B 1/34

[52] U.S. Cl. ..... 100/91; 100/229 A; 100/295

[58] Field of Search ..... 100/90, 91, 102, 229 R, 100/229 A, 295; 53/510, 527; 252/301.1 W; 141/73, 93, 80

[56] References Cited

U.S. PATENT DOCUMENTS

| | | | |
|---|---|---|---|
| 2,605,697 | 8/1952 | Bell | 100/229 R X |
| 2,607,435 | 8/1952 | Dohse | 100/90 |
| 2,922,360 | 1/1960 | Monk | 100/229 R |
| 3,000,295 | 9/1961 | Fenton | 100/269 R X |
| 3,353,478 | 11/1967 | Hopkins | 100/229 A |
| 3,377,945 | 4/1968 | Davis | 100/90 |
| 3,911,807 | 10/1975 | Birnbaum | 100/229 A |
| 4,008,658 | 2/1977 | Stock | 100/91 X |
| 4,108,063 | 8/1978 | Randolph | 100/91 X |

FOREIGN PATENT DOCUMENTS

| | | | |
|---|---|---|---|
| 1535356 | 12/1978 | United Kingdom | 100/90 |

*Primary Examiner*—Billy J. Wilhite

*Attorney, Agent, or Firm*—Mason, Fenwick & Lawrence

[57] ABSTRACT

A trash compactor has a base frame with vertical I-beam piston guide means supporting a rectangular piston for vertical reciprocation; a plurality of suction openings extend about the periphery of the piston adjacent the end face of the piston and are connected to a vacuum source with flexible seal flaps on the periphery of the piston engaging the sides of an open-topped trash container as the piston moves into the container so that dust resultant from trash compaction is removed by the suction openings to a filter box for disposal.

10 Claims, 6 Drawing Figures

COMPACTOR

BACKGROUND OF THE INVENTION

This invention is in the field of trash compactors and is more specifically directed to a trash compactor for use in compacting trash having low-level radiation such as floor sweepings, paper, wood particles and the like from a nuclear power plant. Regulations of the Nuclear Regulatory Agency require that trash materials having even a low level of radiation be disposed of in a safe manner which will not result in the dispersement of the radioactive material into the environment. Such materials are usually compacted in plastic bags and buried at a secure site. Disposal of such materials has been quite difficult in the past due to the fact that the materials such as floor sweepings contain large quantities of light materials such as dust, dirt and small paper scraps which can be easily airborne and dispersed into the environment if compacted by conventional compacting equipment. Prior procedures for disposing of such low-level radioactive waste, such as in U.S. Pat. No. 4,008,658, have not proven to be entirely satisfactory for a variety of reasons. Many of the prior known procedures have been quite time consuming in operation and labor expensive so as to create a substantial economic burden. Other prior known devices are those of U.S. Pat. Nos. 3,000,295; 2,607,435; 3,377,945; 3,353,478 and 2,605,697.

Therefore, it is the primary object of this invention to provide a new and improved trash compactor.

A further object of the present invention is the provision of a new and improved trash compactor capable of compacting lightweight low-level radioactive materials without any discharge of dust or other lightweight portions of such materials into the atmosphere.

Achievement of the foregoing objects is enabled by the preferred embodiment of the invention which comprises a base frame on which a rectangular plywood trash container box is positioned. A plastic liner bag is provided on the interior of the box for receiving the trash materials to be compacted which may already be loosely held in other plastic bags or may be simply loosely deposited in the container. First and second vertical guide standards extend upwardly adjacent each end of the trash container for vertically guiding a rectangular hollow piston member attached to the upper ends of first and second hydraulic cylinder rods having their head ends attached to the base frame. Upon actuation of the hydraulic cylinders, the rectangular piston is moved downwardly along the vertical standards to be matingly positioned in the trash container for compacting the contents thereof.

The rectangular piston has an end face plate which directly engages the trash materials within the container to effect the compacting function thereof. A plurality of suction apertures are provided about the side and end edges of the rectangular piston upwardly from the end face plate with the suction openings being connected to manifold members on the interior of the rectangular piston. The manifold members are connected by flexible hose connectors to a vacuum source so that suction is continuously applied to the suction openings. Additionally, the rectangular piston includes rubber-like flap sealing members attached to its peripheral surface immediately upward of the suction openings with the rubber flap sealing members being dimensioned to engage the side and end walls of the trash container. When the piston moves downwardly, the rubber-like seal members engage the container and the suction applied to the suction openings assures that any dust or other lightweight loose particles dislodged by the compacting operation of the piston on the trash materials is sucked into the manifold and thence conveyed to a disposable filter box having an absolute filter in which all of such materials are trapped.

One side and both ends of the trash container box are engaged by fixed frame members on the base frame for preventing the outward bulging of such sides and ends during the movement of the piston downwardly into the container for compacting the materials in the container. Additionally, a plurality of pivotal restrainer arms are mounted on the piston and support a restrainer plate brought into engagement with the remaining side of the container box as the piston moves downwardly so as to prevent outward bulging of the remaining side of the container box. However, upon upward movement of the piston to its elevated position, the restrainer plate engaging the remaining side completely clears the trash container so that it can be easily removed from the base frame by a forklift or the like moved into position adjacent the side of the container previously contacted by the restrainer arm members.

A better understanding of the preferred embodiment of the invention will be achieved when the following detailed description is considered in conjunction with the appended drawings in which like reference numerals are used for the same parts as illustrated in the different figures.

DESCRIPTION OF THE PREFERRED EMBODIMENT

Figure 1:
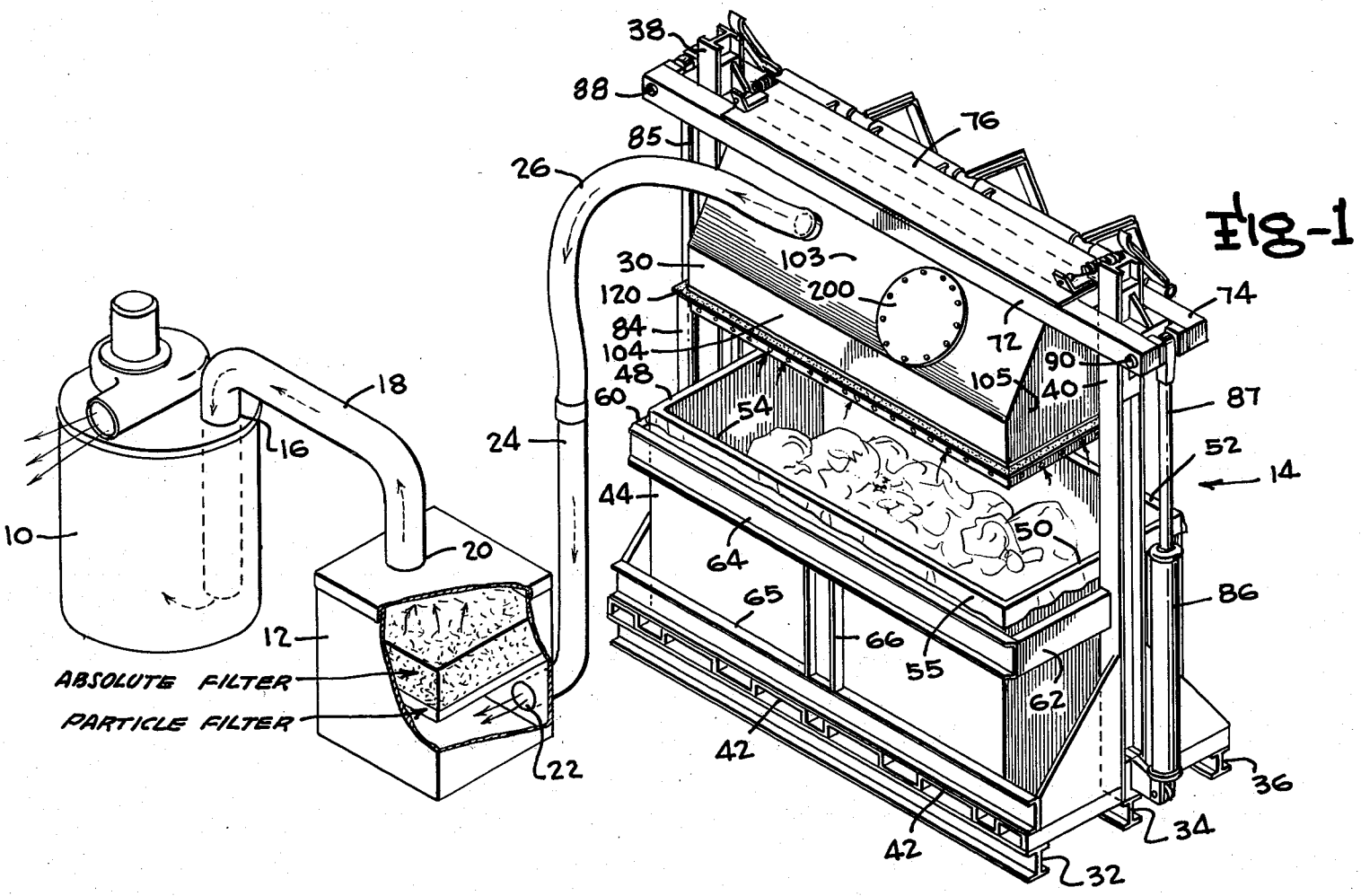
FIG. 1 is a perspective view of the preferred embodiment.

Attention is initially invited to FIG. 1 of the drawings which illustrates the primary components of the preferred embodiment which comprise a conventional vacuum pump 10, a disposable filter box 12, and a compactor 14. Vacuum pump 10 includes an air inlet 16 connected by a first conduit 18 to an outflow opening 20 of the filter box 12. Additionally, the filter box 12 includes an inflow opening 22 connected by a second conduit means 24 including a flexible hose portion 26 to a hollow rectangular piston 30 of the compactor 14.

Figure 2:
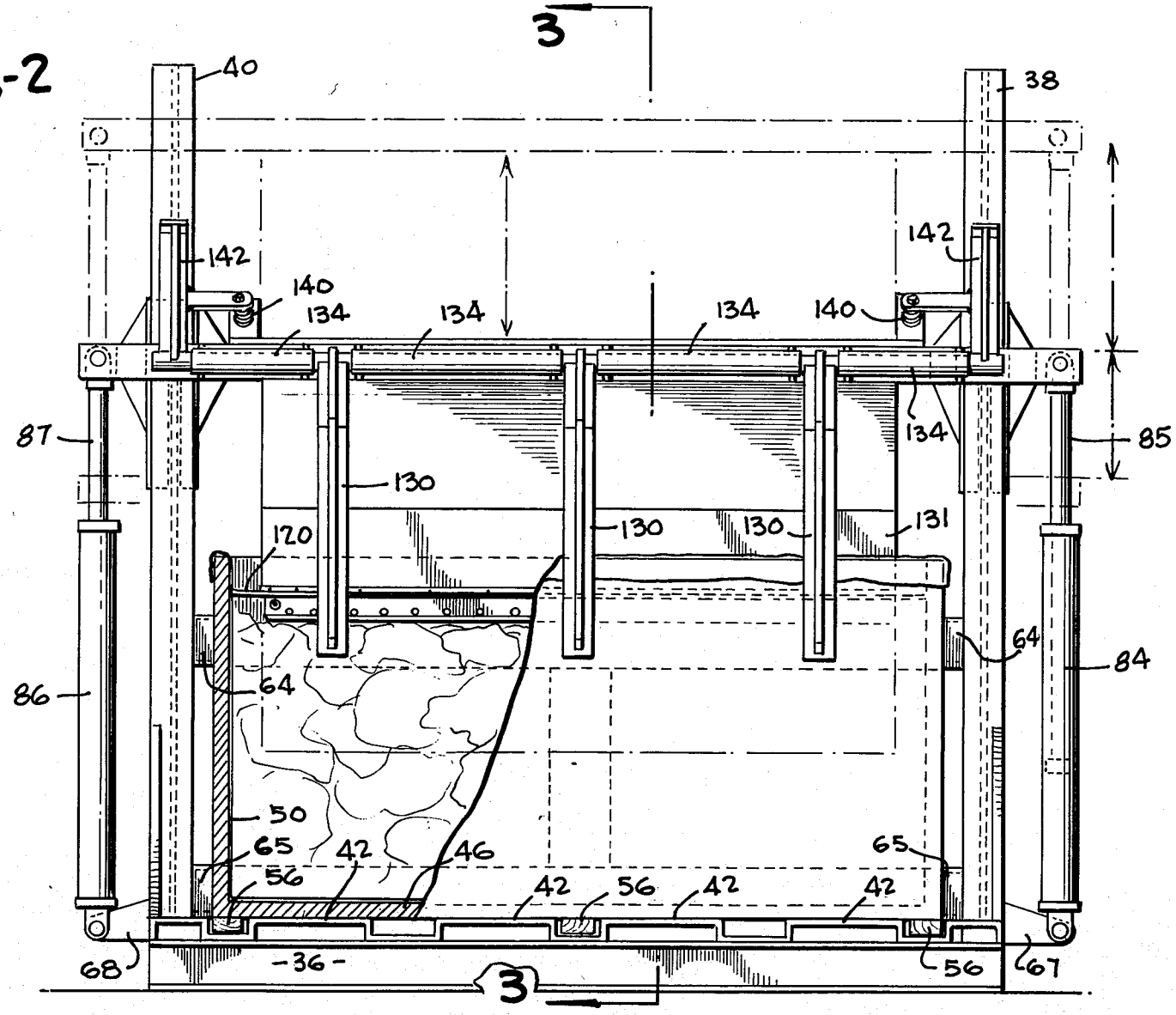
FIG. 2 is a side elevation view of the preferred embodiment with portions removed for the sake of illustration.

In addition to piston 30, compactor 14 includes a base frame consisting of parallel I-beams 32, 34 and 36 which rest upon the floor or other supporting surface and first and second vertical standards 38 and 40 which are also I-beams. Channel members extending transversely across the upper surfaces of the beams 32, 34 and 36 provide support for plates 42 on which an open-topped trash container in the form of a plywood box 44 is supportingly positioned. Box 44 includes a floor portion 46, end walls 48 and 50 and side walls 52 and 54. Guide strips 56 on the bottom of the floor portion 46 are positioned in open-topped slots provided between the support plates 42 as shown in FIG. 2 for effectively and accurately aiding in the positioning the box 44 on the base frame of the compactor. Additionally, the box is also accurately positioned beneath the piston 40 by end frame members 60 and 62 which respectively engage the end walls 48 and 50 of the trash containing box 40 to prevent the outward bowing of the end walls when the piston 30 compacts the trash in plastic liner bag 55 held within the container. The end walls are also braced by the vertical standards 38 and 40. The side wall 54 is braced by horizontal frames 64 and 65 and a vertical frame 66.

Figure 3:
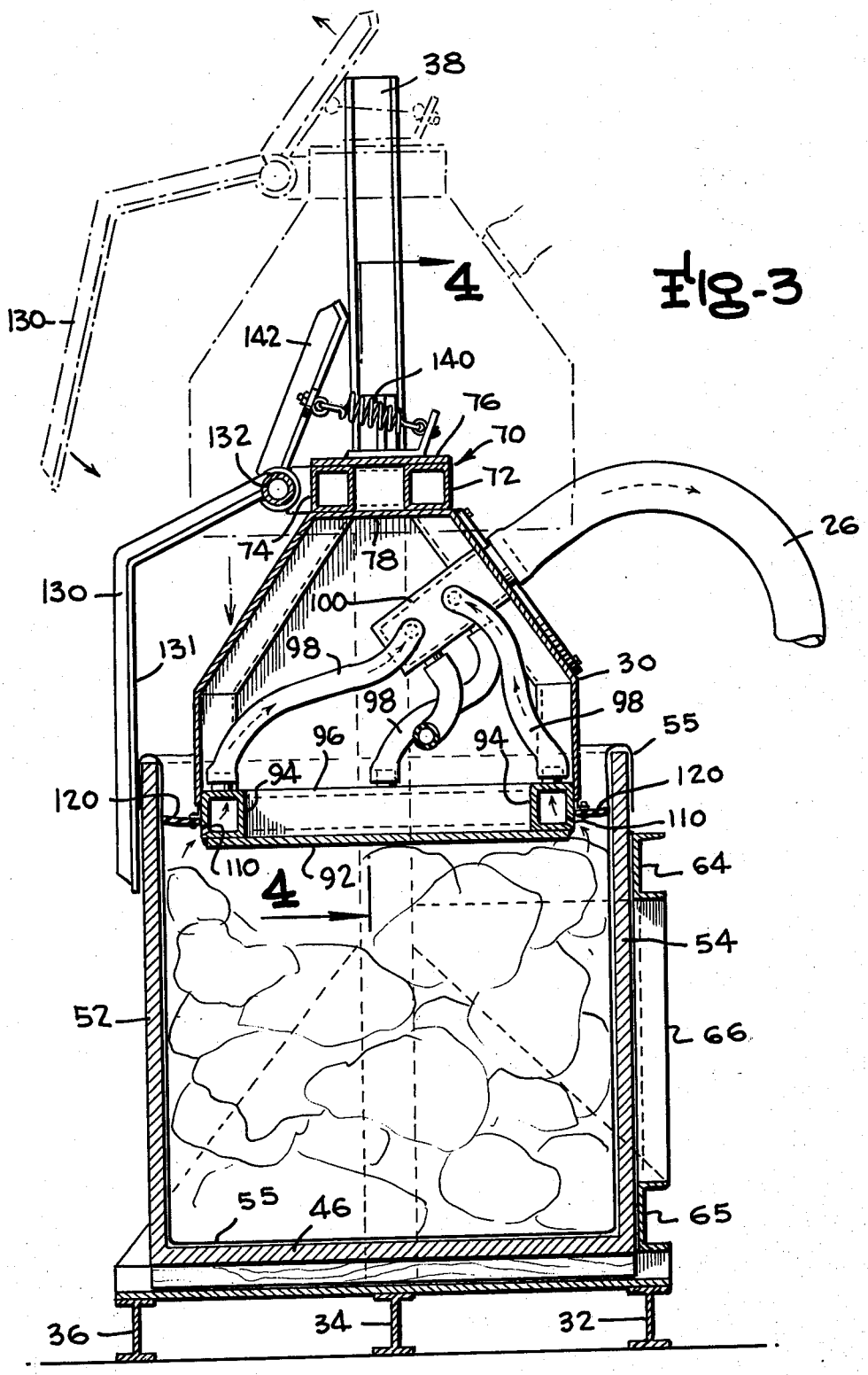
FIG. 3 is a sectional view taken along lines 3—3 of FIG. 2.
Figure 4:
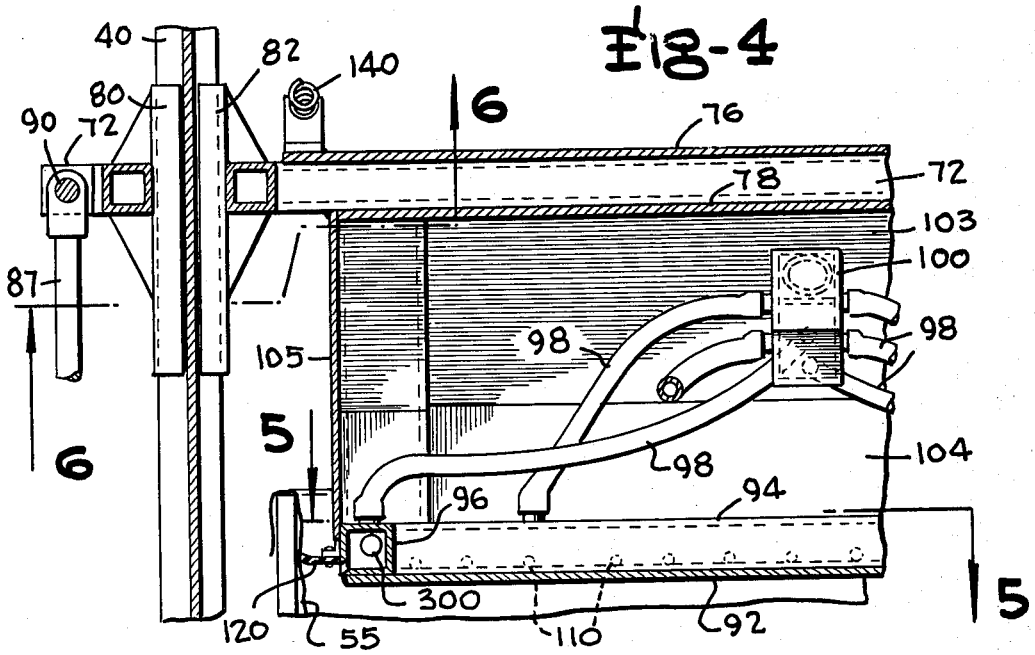
FIG. 4 is a sectional view taken along lines 4—4 of FIG. 3.
Figure 5:
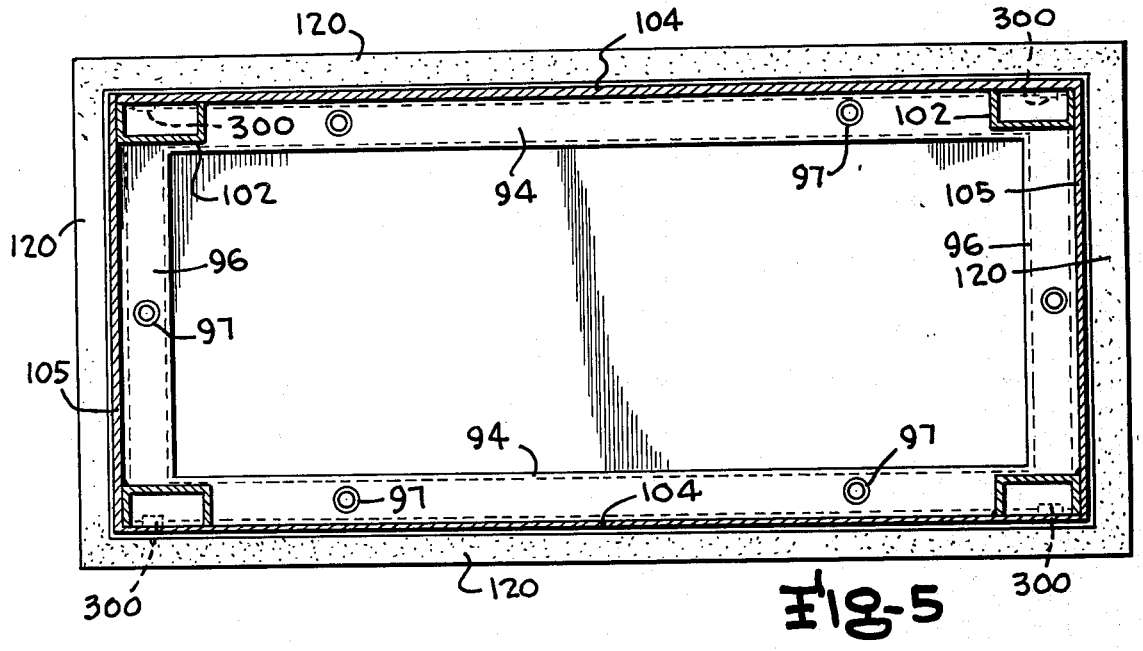
FIG. 5 is a sectional view taken along lines 5—5 of FIG. 4.
Figure 6:
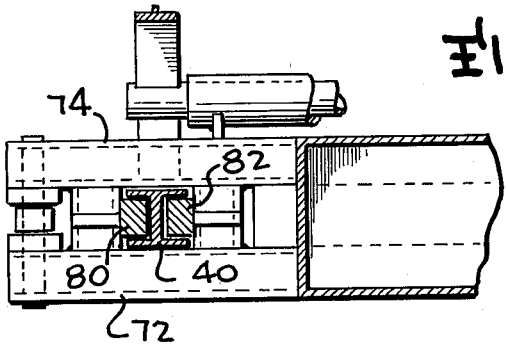
FIG. 6 is a sectional view taken along lines 6—6 of FIG. 4.

Rectangular compressor piston 30 is supported on a cross-head frame 70 formed of parallel box frames 72 and 74 and upper and lower plates 76 and 78 as shown in FIG. 3. It will be observed that the box frame members 72 and 74 extend outwardly beyond the upper plate 76 and the lower plate 78 with slide members 80 and 82 being provided in the space between the outer ends of box frame members 72 and 74 and received between the flanges of the vertical standards 38 and 40 in the manner illustrated in FIG. 4 and in FIG. 6. The slide members 80 and 82 ensure that the compactor piston 30 remains in horizontal orientation as it is moved upwardly and downwardly by the action of first and second hydraulic cylinders 84 and 86 which have their head ends pivotally connected to brackets 67 and 68 on the base frame and which have their rods 85 and 87 respectively connected to pivot pins 88 and 90 in the outer ends of the box frame members 72 and 74 as shown in FIG. 1 and as also shown in FIG. 2. Cylinders 84 and 86 are actuated in unison by hydraulic fluid from a pump (not shown) for raising or lowering the piston 30.

Hollow rectangular piston 30 includes an end face plate 92 to the upper surface of which hollow box manifold elements 94 are welded along the longer edges with shorter box manifolds 96 being welded along the end edges. Corner reinforcement channel members 102, side plates 103, 104 and end plates 105 are all welded together with end face plate 92 to provide a rigid and strong constriction for piston 30.

Each of the box manifold members 94, 96 is closed at each end and is provided with at least one nipple 97 to each of which a flexible hose 98 extending from a vacuum inlet coupling 100 is in turn connected. Coupling 100 is connected to the flexible hose portion 26 as best shown in FIG. 3. Consequently, the vacuum created by the pump 10 acts through the filter box 12, conduit 24, hose 26, coupling 100 and hose member 98 to subject the interior of the box manifold elements 94 and 96 to the vacuum. Additionally, suction openings 110 are provided along the length of the box manifold elements 94 and 96 about the entire periphery of the piston so that the vacuum in the box manifolds causes an inflow of air through the suction openings 110 as shown in FIG. 3. A flexible rubber or the like seal strip 120 is attached to the outer surface of the piston periphery above the suction openings 110 and is dimensioned to engage the side walls of the container 44 or the inner surface of the plastic liner bag 55 which is engaged with the side walls and end walls of the container in the manner illustrated in FIG. 3. Seal strips 120 act to prevent the escape of any dust or the like from the box 44.

Additionally, arms 130 supporting a restrainer plate 131 are supported on a pivot axle 132 extending along the outer side of box frame member 74 and supported by tubular bearings 134 attached to box frame member 74. Arms 130 are pivoted in a clockwise direction by a spring 140 extending between a bracket on the upper plate 76 and a pivot lever 142 provided at each end of the pivot axle 132. The upper end of the pivot lever 142 is biased against the side of the vertical standard with which it is associated so that the parts assume the position illustrated in FIG. 3 when the piston is in its lower positions of movement. However, when the piston is moved to its uppermost dotted line position of FIG. 3, the pivot lever 142 pivots further in the clockwise direction to swing the arm 130 to the dashed line position. Upon subsequent downward movement, the clamp arms 130 and plate 131 swing into position adjacent the outer surface of the side wall 52 as shown in FIG. 3. Clamp arms 130 and plate 131 consequently prevent outward bulging of the side wall 52 as the piston moves downwardly to compress the trash contents within the liner bag 55.

In operation, the piston and end face plate 92 thereof move downwardly slowly with hydraulic cylinders 84 and 86 being contracted at a uniform rate by conventional flow controls; vacuum pump 10 is simultaneously operated so that any dust or other light trash particles freed from the trash by the compaction thereof are not permitted to escape by seal strips 120 and are immediately sucked into the box manifold elements 94 or 96 and deposited in the discardable filter box 12. Piston movement is sufficiently slow to ensure that there is not pressure buildup in the box 44 which remains under vacuum conditions at all times by virtue of operation of pump 10. When the filter box becomes loaded with such particles, it is simply disposed of by itself being placed in box 44 and compressed or by other suitable disposal procedures. Maintenance procedures are easily performed by virtue of a removable access plate 200 permitting maintenance access to the interior of the piston and by removable plugs 300 which permit the flushing of trash or dust from the manifold means 94 and 96. Thus, it has been found that the present invention results in a substantial savings in time in disposal of the low radiation level trash as compared to previously employed systems.

Numerous modifications of the preferred embodiment will undoubtedly occur to those of skill in the art and it should be understood that the spirit and scope of the invention is to be limited solely by the appended claims.

I claim:

1. A trash compactor including a base frame means, a compactor piston having side wall means and an end face, piston guide means supporting piston for linear reciprocation with respect to said base frame means, a plurality of suction openings positioned about the periphery of said piston in said side wall means, a vacuum source, means connecting said vacuum source to said suction openings, an open-topped trash container mounted on said frame means and dimensioned to matingly receive said compactor piston and power drive means for reciprocating said compactor piston into and out of said open-topped trash container.

2. A trash compactor as recited in claim 1 additionally including seal means extending about the periphery of said piston at a location spaced farther from said end face than said suction openings and dimensioned to sealingly engage the inner surface of said open-topped container.

3. A trash compactor as recited in claim 1 additionally including flexible sealing flap means attached to the periphery of said piston at a location spaced farther from said end face than said suction openings and dimensioned to sealingly engage the inner surface of said open-topped container when said piston is moved into said open-topped container.

4. A trash compactor as recited in claim 3 wherein said vacuum means includes a vacuum pump having an air inlet, a disposable hollow filter box having an inflow opening at one end and an outflow opening at an opposite means, filter means mounted in said hollow box between said inflow opening and said outflow opening, first conduit means connecting said outflow opening to said air inlet of said vacuum pump and second conduit means connecting said inflow opening to said suction openings.

5. A trash compactor as recited in claim 1 wherein said end face of said piston is of quadrilateral configuration and said power drive means comprises hydraulic cylinder means.

6. A trash compactor of claim 5 additionally including flexible sealing means attached to the periphery of said piston at a location spaced farther from said end face than said suction openings and dimensioned to sealingly engage the inner surface of said open-topped container when said piston is moved into said open-topped container.

7. A trash compactor as recited in claim 6 wherein said vacuum means includes a vacuum pump having an air inlet, a hollow box having an inflow opening at one end and an outflow opening at an opposite means, filter means mounted in said hollow box between said inflow opening and said outflow opening, first conduit means connecting said outflow opening to said air inlet of said vacuum pump and second conduit means connecting said inflow opening to said suction openings.

8. A trash compactor as recited in claim 1 wherein said open-topped container has four vertical walls and said end face of said piston is of quadrilateral configuration and additionally including flexible sealing strip members attached to the periphery of said piston at a location spaced farther from said end face than said suction openings and dimensioned to sealingly engage the inner surface of said open-topped container when said piston is moved into said open-topped container and means for preventing outward bowing of the walls of said container including fixed frame members engaging the outer surface of three of said walls of said container and a movable restrainer plate mounted on said piston for engaging the fourth of said walls as the piston moves into said container while completely clearing said fourth wall when the piston is moved upwardly above said container.

9. A trash compactor as recited in claim 8 wherein said vacuum means includes a vacuum pump having an air inlet, a hollow box having an inflow opening at one end and an outflow opening at an opposite means, filter means mounted in said hollow box between said inflow opening and said outflow opening, first conduit means connecting said outflow opening to said air inlet of said vacuum pump and second conduit means connecting said inflow opening to said suction openings.

10. A trash compactor as recited in claim 9 wherein said piston guide means comprises first and second vertical I-beam standards mounted at their lower ends on said base frame means and further including pivot means supporting said restrainer plate for pivotal movement along one side of said compactor piston.

* * * * *